United States Patent [19]

Wetzel et al.

[11] 4,430,795

[45] Feb. 14, 1984

[54] SAFETY DEVICE FOR CHAIN SAW

[76] Inventors: Robert Wetzel, 2724 Whitetail Deer Rd., Bath, Pa. 18014; Richard Bates, R.D. #1, Box 403, Schuylkill Haven, Pa. 17972

[21] Appl. No.: 404,503

[22] Filed: Aug. 2, 1982

[51] Int. Cl.[3] ..... B27B 17/02

[52] U.S. Cl. ..... 30/382; 30/387; 83/831

[58] Field of Search ..... 83/62, 67, 68, 831; 30/382, 383, 384, 385, 386, 387

[56] References Cited

U.S. PATENT DOCUMENTS 2,924,254 2/1960 Smith ..... 30/383
3,323,561 6/1967 Lahtinen ..... 30/383
3,991,470 11/1976 Cartmill ..... 30/382
4,257,162 3/1981 Pardon ..... 30/382

*Primary Examiner*—Jimmy C. Peters
*Attorney, Agent, or Firm*—Ruth Moyerman

[57] ABSTRACT

A chain saw safety improvement is disclosed. Enclosed in a hollow guide bar is a link positioning device which moves the links on the chain into a cutting or safety position. This device is spring tensioned and normally in the safety position. The chain links themselves are pivotable and scythe-shaped, the tips acting as safety tails. When the link positioning device is in its normal safety position, it pushes the safety tails, moving the links into a noncutting position. When tension is manually released by the operator, the links may move into their cutting position.

11 Claims, 12 Drawing Figures

SAFETY DEVICE FOR CHAIN SAW

BACKGROUND OF THE INVENTION

1. Field of the Invention

This invention relates to chain saw cutting, and more particularly to the cutter assemblage or cutter element.

2. Prior Art

In recent years, the increasing use of chain saws has produced an increase in the number of accidents and mutilations caused by them. Certain safety devices have been developed to improve the safe use of chain saws such as anti-kickback devices, right and left hand guards, etc. These devices are bulky and awkward. As such, they are either not used or often removed after a few uses. They also do not protect the user from injury at all times when the chain saw is in operation. These devices are often not an integral part of the chain saw and are provided only as accessories. There currently is not a device which renders safe usage to a chain saw which is permanently in place, always in its safety position unless overriden, and which does not interfere with the efficient, comfortable use of the chain saw.

SUMMARY OF THE INVENTION

The aforementioned prior art problems are overcome by the safety device of this invention which contemplates safety or shielding links in the chain which are activated by a plate within the guide bar. The safety device has a pair of parallel, co-planar, movable contact plates housed within the hollow guide bar of a chain saw. Longitudinal movement of a wedging spreader, also located within the guide bar between the plates, results in transverse movement of the plates. The transverse movement of the plate causes engagement with pivoting links located on the chain. The pivoting links have a scythe shape or tail section and it is the tail section of the links contacting the edge of the plates which induces a bias in the link placement. This bias disrupts the cutting surface and prevents the chain saw from effectively cutting. The plates and the pivoting links, are retained in the non-cutting mode via a spring tensioning device attached to the wedging spreader. The bias of the non-cutting mode may be nullified by a hand activated override mechanism.

A mechanism is provided for locking the chain saw in a cutting mode after the safety device is manually overriden. A round headed pin normally protruding from aligned apertures in the plates of the guide bar is pressed inward by the kerf during operation, thereby holding the plates in a cutting mode automatically.

The safety device of this invention is designed to prevent a chain saw from accidentally cutting by providing a normal safety position and manual override until the saw has engaged the kerf of the wood to be cut, after which the safety is disengaged.

It is therefore an object of this invention to provide a chain saw safety device which, by means of movable plates, normally biases the cutter or deflecting link and thereby prevents the saw from accidentally cutting a surface.

It is another object of this invention to provide a manually activated safety override mechanism whereby the chain saw can be used for cutting when the override is engaged by the chain saw operator.

It is still another object of this invention to provide a cutting mode lock via a round headed pin which is activated as the chain guide bar is engaged in a kerf.

It is yet another object of this invention to prevent "kickback" by causing the non-cutting mode of the chain to be in place when the chain goes around the nose of the guide bar.

These and other objects will be more readily ascertainable to one skilled in the art by reference to the accompanying drawing and exemplary embodiments that follow.

BRIEF DESCRIPTION OF THE DRAWING(S)

DETAILED DESCRIPTION OF THE PREFERRED EMBODIMENT(S)

Figure 1:
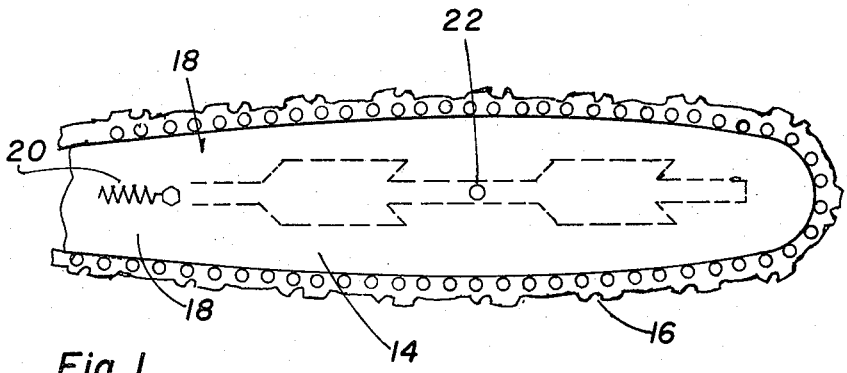
FIG. 1 is a fragmentary elevation of the invention with the link positioning device shown in phantom.

Referring now to FIG. 1, guide bar 14 is shown having aperture 22 and chain 16 around its perimeter. Chain 16 is discussed in detail in FIGS. 4, 5, 6, 7 and 8. Shown in phantom within guide bar 14 is link positioning device 18 attached to spring 20. FIG. 1 shows the relationship of chain 16 to link positioning device 18 while the following Figures describe their interaction in greater detail. That is to say, link positioning device 18 can be made to engage the links of chain 16 as they rotate.

Figure 2:
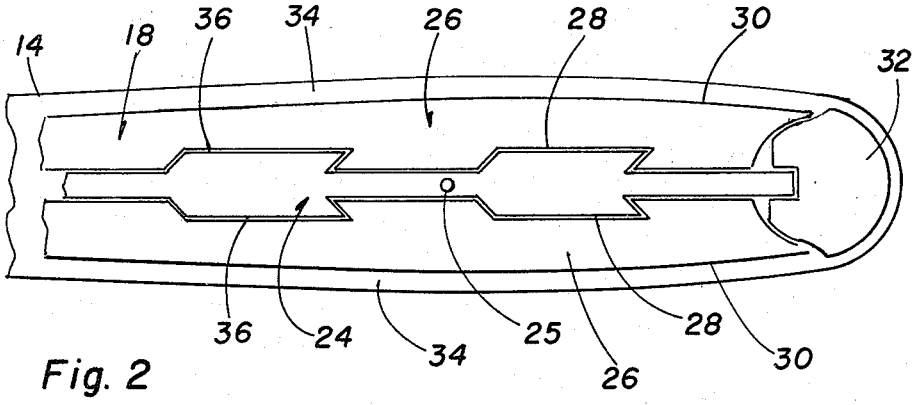
FIG. 2 is a fragmentary elevation with both chain and outer nose guard plate removed, showing the link positioning device in the cutting position.
Figure 3:
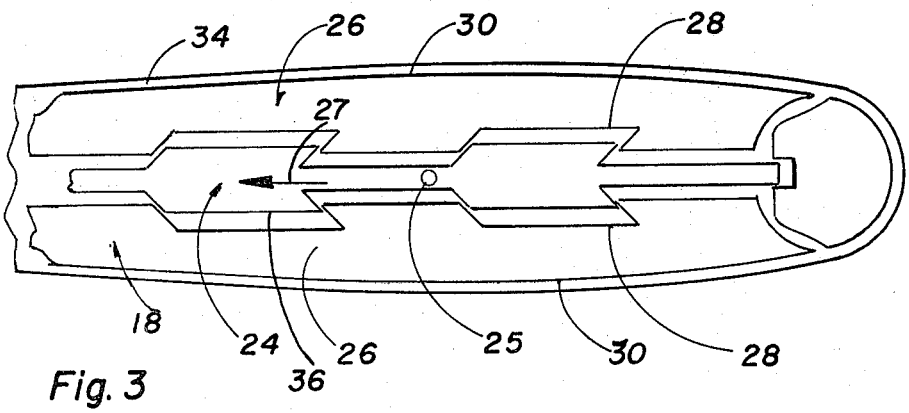
FIG. 3 is a fragmentary elevation with both chain and outer nose guard plate removed showing the link positioning device in the safety position.

Referring now to FIGS. 2 and 3, link positioning device 18, within guide bar 14, is shown in its engaging operation. FIG. 2 shows link positioning device 18 in its first, or cutting, position with a pair of co-planar plates 26, each having an inner edge 28 and an outer edge 30. Cutting is possible in the position shown in FIG. 2 as will be explained in reference to FIG. 4 because of the relatively large space 34 created by moving of the plates. Spreader 24, having edges 36, has aperture 25 which is discussed more fully with reference to FIGS. 11 and 12. Also shown is nose bar 32 which is conventional and forms no part of this invention. Additionally, nose bar 32, while shown preferably as a shouldered nose, may be of sprocket type as is conventional in chain saws on the market today.

Contrasted to FIG. 2, FIG. 3 shows link positioning device 18 in its second, or noncutting, position. Cutting is not possible because space 34 has been reduced by the transverse movement of edges 30 of plates 26 caused by the longitudinal movement of spreader 24 as shown by arrow 27. This longitudinal movement is caused by wedged edges 36 of spreader 24 pushing on inner edges 28 of plates 26, moving them transversely.

Figure 4:
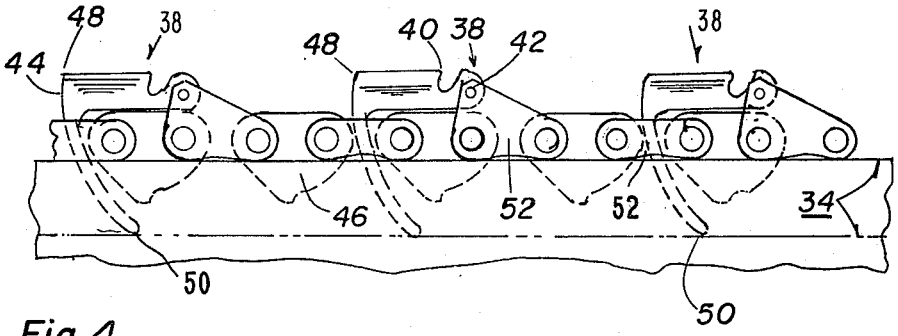
FIG. 4 illustrates a fragmentary length of saw chain embodying one species of the invention shown in the cutting position.
Figure 5:
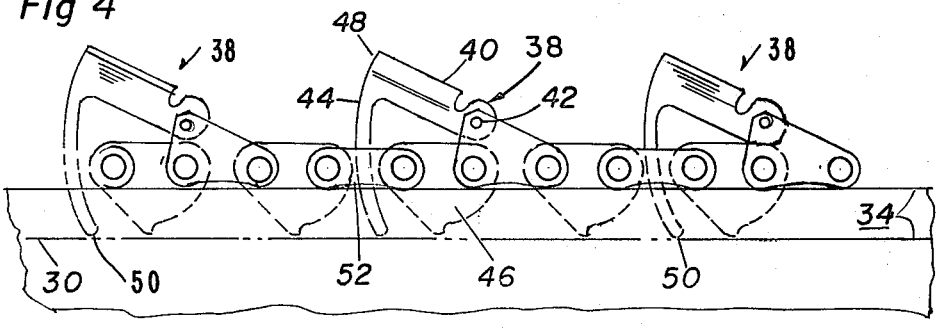
FIG. 5 shows a fragmentary length of saw chain embodying one species of chain safety link in the safety position.

Referring now to FIGS. 4 and 5, a first species of pivotable links in chain 16 is shown. Pivoting link 38 which is shown in both FIGS. 4 and 5 includes a cutting edge 40, a pivot point 42 and a safety tail 44. It is attached to side links 52 at pivot point 42. This side link 52 is in turn attached to drive links 46. Also shown is side links 52 which join drive links 46 to each other. In this first species, pivoting link 38 includes both cutter edge 40 and safety tail 44 incorporated into one pivotable link.

Referring now to FIG. 4, pivoting link 38 is shown in the cutting position. Cutting is possible because cutting edge 40 is positioned above safety tail top point 48, lower point 50 of safety tail 44 having dropped into the enlarged space 34. Pivotable movement of link 38 is possible because link 38 is attached to side link 52 at pivot point 42. Thus, as shown in FIG. 2, plates 26 have created a large space 34, allowing safety tail 44 to drop into space 34 and to position cutting edge 40 where it will contact a surface to be cut.

When plates 26 are positioned as shown in FIG. 3, the links of chain 16 are forced into their noncutting position as shown in FIG. 5. This noncutting mode occurs because space 34 is reduced, as shown in FIG. 3, by outer edge 30 of plate 26. Edge 30 then contacts lower point 50 of safety tail 44, pushing safety tail upper point 48 to a position above cutting edge 40. Cutting edge 40, therefore, would not contact the surface to be cut.

Figure 6:
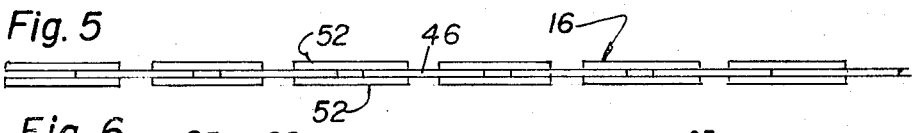
FIG. 6 is a fragmentary top planar view of the chain of FIGS. 4 and 5.

FIG. 6 is a top view of chain 16 showing the position of other links in chain 16 of FIGS. 4 and 5. Drive links 46 are positioned between side links 52 as is conventional.

Figure 7:
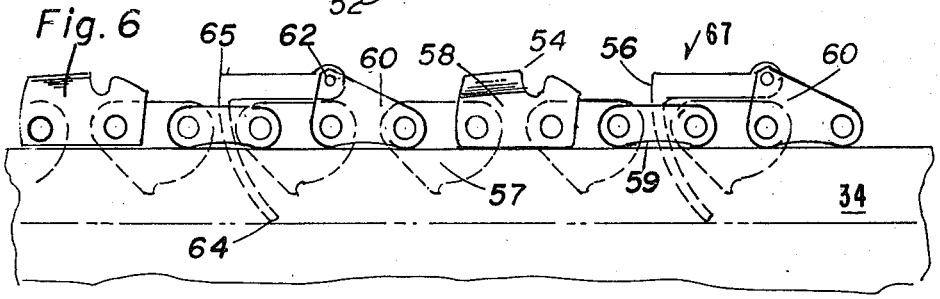
FIG. 7 illustrates a fragmentary length of saw chain embodying another species of the chain safety link shown in the cutting position.
Figure 8:
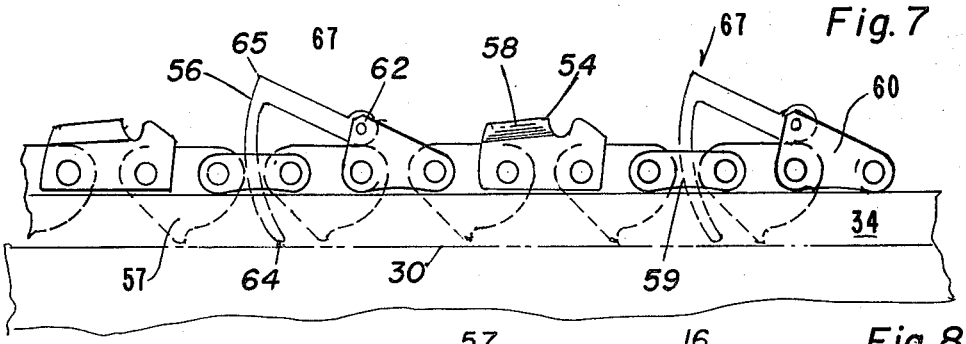
FIG. 8 shows a fragmentary length of saw chain embodying said other species of the chain safety link in the safety position.
Figure 9:
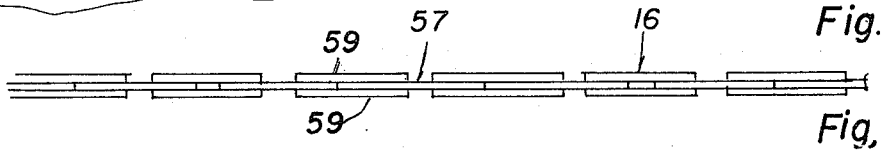
FIG. 9 is a fragmentary top planar view of the chain of FIGS. 7 and 8.

Referring now to FIGS. 7, 8 and 9, another species of pivotable links is shown. A conventional cutter link 58, including cutting edge 54, is utilized. Cutting link 58 is permanently in the position shown in FIGS. 7 and 8. Pivoting safety link 67 includes safety tail 56, attached to a pivot point 62, which tail has a lower point 64 and an upper point 65. Also shown are drive links 57 and two forms of side links 59 which join drive links 57, and side links 60 which join pivoting link 67 to drive links 57.

In FIG. 7, the links are shown in their first, or cutting, position. Cutting is possible because plates 26, as shown in FIG. 2, are in their cutting position creating a relatively large space 34. Thus in FIG. 7, safety tail 56 of link 60 has dropped into space 34 allowing cutting edge 54 on link 58 to be the highest exposed link edge of chain 16 and therefore able to contact and cut material.

In FIG. 8, when pivoting link 67 has been pushed into the position shown, again as previously described in FIGS. 2 and 3, cutting is not possible by cutting link 58 because lower point 64 of safety tail 56 on link 67 is in contact with outer edge 30 of plate 26 and has pushed upper point 65 of pivoting link 67 above cutter link 58, thus preventing cutter link 58 from contacting a surface to be cut. In this instance, plate 26 has moved link 67 to its noncutting mode by being moved itself by spreader 24 as shown in FIG. 3.

FIG. 9 is a top view of chain 16 showing the position of other links of FIGS. 7 and 8. Drive links 57 are positioned between side links 59 as is conventional.

Figure 10:
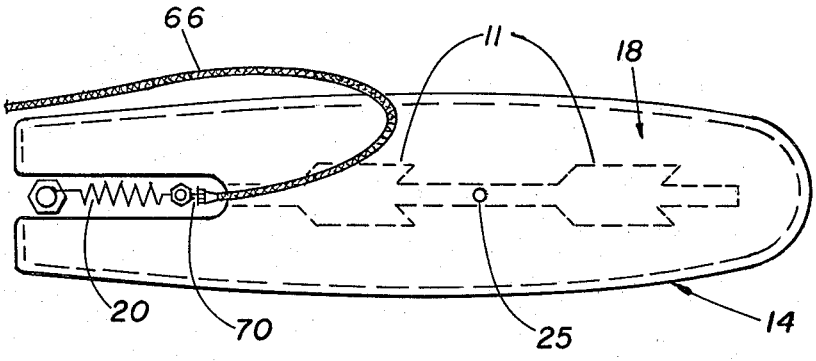
FIG. 10 is a fragmentary elevation of the saw embodying the invention with chain removed and showing a means for moving chain via link positioning device from safety to cutting position.

Referring now to FIG. 10, one example of the mode of biasing is shown including a sleeved cable 66 and spring 20. In this view, link positioning device 18 is shown with aperture 25 (both in phantom). Link positioning device 18, shown within guide bar 14, is normally biased in its safety position by means of spring 20 attached to a threaded stud 70, which stud, in turn, is mounted on plate 24. In order to overcome the bias and allow cutting, cable 66 (also attached to stud 70) may be retracted within its sleeve to move link positioning device 18 to its cutting position. Thus, when cable 66 is retracted, spring 20 is tensioned and link positioning device 18 is temporarily shifted into its cutting mode. Cutting is thus possible only as long as cable 66 is being retracted. At the moment of release of cable 66's normal spring bias resumes and link positioning device 18 once again returns to its safety position and pushes links of chain 16 to their safety, or noncutting, position. Retraction of cable 66 may accomplished by means of a lever mounted on the handle of the power head unit in the general vicinity of where the operator normally places his left hand. This lever would be actuated by the operator's index finger.

Figure 11:
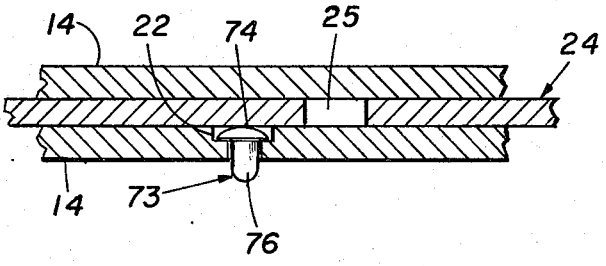
FIG. 11 is a fragmentary section taken along lines 11—11 of FIG. 10 showing the automatic device in the guide bar aperture with the pin protruding.
Figure 12:
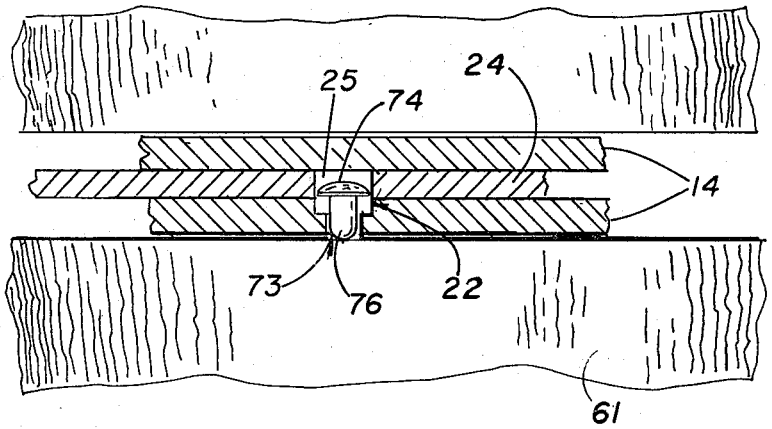
FIG. 12 is a fragmentary section taken along lines 11—11 of FIG. 10 showing the automatic device of FIG. 11 in the spreader aperture with the pin recessed.

An automatic device 73 for securing spreader 24 of link positioning device 18 in its cutting position is shown in FIGS. 11 and 12 which are both fragmentary cross sections taken on lines 11—11 of FIG. 10. FIGS. 11 and 12 show automatic device 73 which has a round head 74 and an outward extending shaft 76. Automatic device 73 is permanently retained in guide bar 14 with its shaft 76 extending through aperture 22 and its head 74 abutting a shouldered portion of said aperture.

FIG. 11 shows automatic device 73 in position when cutting is not taking place. Shaft 76 extends beyond guide 14. Head 74 is not securing spreader 24 at aperture 25, but is contained within the shouldered portion of aperture 22.

In FIG. 12, when cutting is taking place and guide bar 14 is in wood, kerf 61 presses against shaft 76 and forces automatic device 73 upward. Round head pin 74 is then pushed into aperture 25 which has been aligned with aperture 22 by movement of spreader 24 to the cutting position. Thus, the operator does not thereafter have to manually maintain the cutting position, as detailed in the discussion in FIG. 10, as long as guide bar 14 is in contact with the kerf. The orientation shown in FIG. 11 will be immediately resumed when spreader 24 moves to its safety position. This happens upon removal of guide bar 14 from contact with kerf 61 because it is no longer there to prevent the head 74 of automatic device 73 from coming out of aperture 25 as spreader 24 is again biased into noncutting position by spring 20.

There are many variations which may be practiced within the scope of this invention. For example, the cable means may be activated by trigger means or other suitable means which may be variously located on or near the handle and still be within the scope of this invention.

Within the scope of this invention, various adjustments may be made to the spreader device in order to achieve several purposes. For one, the spreader plates may be adjusted to push against the drive links of the chain in order to create a drag. This drag would result in friction which would prevent the chain from continued rotation.

Another variation could be a calibration of the link positioning device to allow the operator to alter the rake angle of the cutters to the most efficient cutting position for each species of wood to be cut. To satisfy differing wood requirements, calibration of the link positioning device could be made to utilize the pivoting safety link as a depth of cut gauge.

The spreader mechanism could be designed so that the portion of the link positioning device uppermost when the saw is in use would be continuously in the non-cutting mode, preventing kick-back or unsafe cutting with the top of the saw.

Another variation which may be employed to move links from cutting to non-cutting position contemplates a latching type mechanism actuated by the spreader mechanism 24 which, when released, would allow cutting link to rotate on its axis and invert to expose a non-cutting surface. This variation is applicable where the cutter is of the type illustrated in FIGS. 4, 5 and 6. That is, the cutter is on the pivoting link.

A variation useful with links as illustrated in FIGS. 7, 8 and 9 contemplates a slotting arrangement on side link 60 to cause reciprocating movement of the link instead of the pivoting movement illustrated. It is also possible in this embodiment to alter the link arrangement in that links 59 and 60 could be exchanged, thereby bringing pivoting link 67 closer to cutter edge 54 of cutter link 58.

Standard motor and means for driving the chain may also be assumed within the scope of this invention.

The device of this invention has many advantages. Chiefly among these is its safe use by the operator.

Secondly, this chain saw is normally in the safety position unless manually overriden by the operator, minimizing the chances of accidents.

Thirdly, the device can be held automatically in its cutting position while in a kerf, but will immediately assume the safety position when it is removed from the wood.

Having now described and illustrated my invention, it is not intended that such description limit the scope of this invention, but rather that this invention be limited only by a reasonable interpretation of the appended claims.

What is claimed is:

1. In a motor driven chain saw having a hollow guide bar and a chain operatively driven about the perimetrical edge thereof, the improvement comprising:

(a) a link positioning device, located within said hollow guide bar, which is capable of assuming either of two positions—a first cutting position and a second non-cutting position, said device being normally biased in said second position;

(b) a plurality of pivotable links in said chain, each contacted by said positioning device, which are pivoted into a cutting mode when said positioning device is in its first position and which return to a non-cutting mode when said device is in its second position; and, (c) means for overcoming said normal bias in order to shift said link positioning device from its second position to its first position and to thereby permit cutting.

2. The chain saw according to claim 1 wherein each said pivotable link is generally scythe-shaped including a cutting surface on a straight upper edge thereof and a tail, which tail contacts said link positioning device to cause pivotation of said link and exposure of said cutting surface.

3. The chain saw according to claim 1 wherein the chain includes conventional cutters and wherein, further, each of said pivotable links includes a tail which contacts said link positioning device, a portion of said tail being higher than said cutters when pivotation of said link occurs to thereby prevent said cutters from cutting.

4. The chain saw according to claim 1 wherein said link positioning device includes a pair of generally parallel, variably spaced apart, co-planar plates, capable of transverse movement with respect to each other, said plates having outer edges which contact and position said pivotable links; and a wedging spreader located between said plates and in contact with their inner edges, capable of reciprocal longitudinal motion between pre-determined limits;

longitudinal motion of said wedging spreader causing transverse movement of said plates and consequent pivotation of said links from one position to another.

5. The chain saw according to claim 4 wherein said pivoting links are generally scythe-shaped cutters, having a cutting surface on a straight upper edge thereof and a tail, which tail contacts said link positioning device to cause pivotation of said link and exposure of said cutting surface.

6. The chain saw according to claim 4 wherein the chain includes conventional cutters and wherein, further, each of said pivoting links includes a tail which contacts said link positioning device, a portion of said tail being higher than said cutters when pivotation of said link occurs, to thereby prevent said cutters from cutting.

7. The chain saw according to claim 4 wherein said wedging spreader is spring biased to one limit of its longitudinal travel, and said means for overcoming said bias is a cable linked to said wedging spreader.

8. The chain saw according to claim 4 including, additionally, automatic means for securing said link positioning device in said first position, said means being operative only for as long as said guide bar remains within a kerf.

9. The chain saw according to claim 8 wherein said automatic means for securing said link positioning device includes an aperture in said guide bar, an aperture in said spreader, and a round head pin, the head of which is permanently retained in said guide bar aperture, and the shaft of which normally protrudes outward from said guide bar, said guide bar aperture and said spreader aperture being in alignment only when said link positioning device is in its first position; contact between said protruding shaft and a kerf when said device is in its first position, causing said head to enter said spreader aperture and keep said device in its first position until contact between shaft and kerf is discontinued.

10. The chain saw according to claim 9 wherein said pivoting links are generally scythe-shaped cutters having a cutting surface on a straight upper edge thereof and a tail, which tail contacts said link positioning device to cause pivotation of said link and exposure of said cutting surface.

11. The chain saw according to claim 9 wherein the chain includes conventional cutters and wherein, further, each of said pivoting links includes a tail which contacts said link positioning device, a portion of said tail being higher than said cutters when pivotation of said link occurs to thereby prevent said cutters from cutting.

* * * * *